United States Patent [19]

Russell

[11] Patent Number: 4,736,612

[45] Date of Patent: Apr. 12, 1988

[54] COMPENSATING DIE HOLDER

[75] Inventor: Robert L. Russell, Tinley Park, Ill.

[73] Assignee: Power Brake Dies, Inc., South Holland, Ill.

[21] Appl. No.: 15,667

[22] Filed: Feb. 17, 1987

[51] Int. Cl.[4] ..... B21D 5/02

[52] U.S. Cl. ..... 72/389; 72/462; 72/448; 72/482

[58] Field of Search ..... 72/389, 448, 465, 386, 72/446, 447, 462, 380, 482

[56] References Cited

U.S. PATENT DOCUMENTS

| | | | |
|---|---|---|---|
| 2,199,864 | 5/1940 | Wehr | 72/448 |
| 2,456,856 | 12/1948 | Bath | 72/462 |
| 3,587,286 | 6/1971 | Fritsch | 72/389 |
| 3,965,721 | 6/1976 | Roch | 72/389 |
| 4,106,323 | 8/1978 | Haenni et al. | 72/389 |
| 4,347,727 | 9/1982 | Galiger | 72/389 |
| 4,354,374 | 10/1982 | Deguchi | 72/462 |
| 4,426,873 | 1/1984 | Pearson et al. | 72/389 |
| 4,449,389 | 5/1984 | Cros | 72/389 |
| 4,586,361 | 5/1986 | Reinhorn et al. | 72/389 |

*Primary Examiner*—David Jones

*Attorney, Agent, or Firm*—McCaleb, Lucas & Brugman

[57] ABSTRACT

A compensating bolster and die holder combination for use with the bed of a press brake to provide vertical adjustment and compensating camber to the die holder supported thereby. The die holder is vertically moveable in an open channel of an underlying elongated bolster fitted to the bed of the press; with plural wedge members, moveable transversely of the die holder, serving to adjustably position and support the latter. Each wedge member has joined thereto an indicator pin extending through one side of the bolster which operates to visually indicate the adjusted position of its wedge member; while the several indicator pins cooperate to show the relative adjusted positions of the several wedge members and the consequential adjusted elevation of the die and die holder.

11 Claims, 2 Drawing Sheets

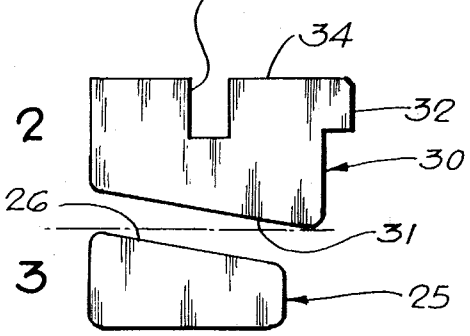
FIG. 2
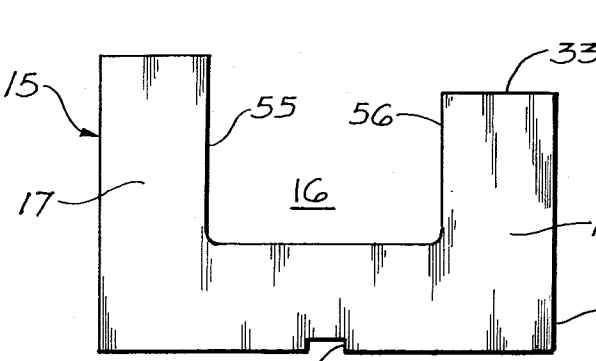
FIG. 3
FIG. 4
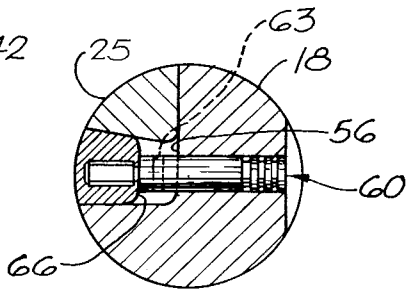
FIG. 9
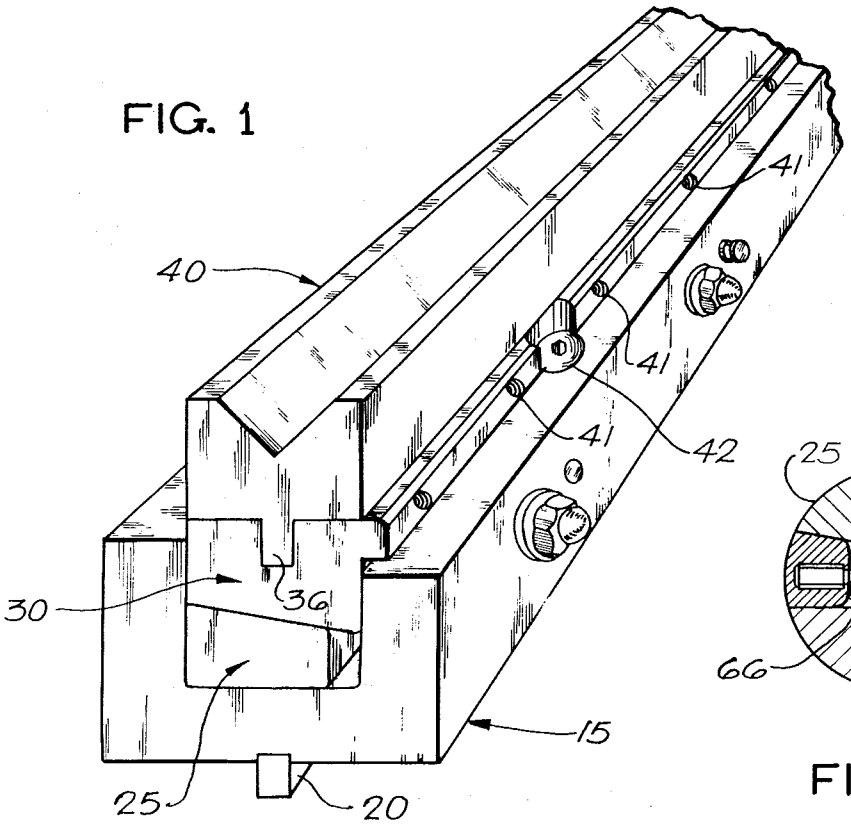
FIG. 1

COMPENSATING DIE HOLDER

This invention relates generally to metal forming bending brakes and presses and more particularly to improvements in die holders useful with such equipment.

It is common practice in the operation of press brakes to use a bolster between the dies and the associated bed and ram of the press brake. In addition is it known to use one or more adjustably moveable wedges between the bolster and the die for the purpose of adjustably varying the camber or crown thereof to obtain straight bends and uniform angles in the formed metal stock. Such adjusted variations serve to compensate for inaccuracies or deflection of the press bed or ram beyond original design limits, usually brought about by excessive usage and wear and operating loads which exceed or otherwise depart from design loads, as well as inaccuracies of the dies and variations in the metal stock being formed. This problem is not so serious in short section bends, but is increasingly troublesome in longer bends.

Examples of such prior art teachings are found in the U.S. Pat. Nos. 2,199,864 to Wehr and 2,456,856 to Bath which teach the use of adjustable bolsters to compensate for deflection in the bed or ram of the press in order to achieve straight bends and uniform bend angles in the articles being produced. While such prior developments generally have been successful and constitute material improvements over the more conventional, but time consuming, use of shims beneath the die holder, adoption of such compensating die holders has not been universal.

One of the principal difficulties encountered in using such prior compensating bolsters and die holders lies in the inability of the operator to readily determine and measure the compensating camber provided thereby and/or the adjusted position of the moveable wedges utilized to provide the camber variations. Consequently, unless the adjustable wedges are returned to their initial start position at one limit of their movement erroneous camber and uneven support of the die holder can take place resulting in serious damage or breakage to the die or press.

SUMMARY OF THE INVENTION

This invention provides improved compensating die holder means which obviates the aforenoted problem of the prior art developments.

In brief, the present invention provides an improved combination for compensating die holders in which an elongated die support is slidably mounted in an open channel of an underlying elongated bolster block; the die holder being positioned over wedge means comprising one or more individual wedge members undersupporting the die holder and independently moveable transversely of the bolster and die holder to selectively adjust the die support thereby to achieve a desired compensating camber to the undersupport of the die. Adjustable movement of the wedge means is effected by threading engagement thereof with rotatable adjusting bolt means which extend transversely through the bolster block and wedge means; with the individual wedge members moving along the axis of an associated adjusting bolt means and transversely across the channel of the bolster block beneath the die holder. Means for determining the exact position of each wedge member relative to the die holder as well as the relative position thereof to one another and for visually indicating such position and overall height of the crown or camber adjustment to the operator, comprises at least one indicator pin moveable with each wedge member; such pins extending through one wall of the bolster block so as to be visually perceivable by the operator exteriorly of the bolster block.

A principal object of this invention is to provide a compensating die holder for a forming press having means for indicating compensating camber provided to the holder.

Another important object of this invention is to provide a compensating die holder employing undersupporting wedge means for the die holder which are operable to provide selected operating camber to a die held therein and in which visual indicator means are provided to indicate the adjusting camber and position of the wedge means.

Another important object of this invention is to provide an improved compensating die holder means employing a plurality of individually moveable wedge members for adjustably undersupporting a die holder and means for indicating the position of each wedge member with respect to the die holder.

Still another object of this invention is to provide a compensating die holder, as set forth in the immediately preceeding object, in which the means for indicating the position of the plural wedge members include scale means measuring the movement of the wedge members from a neutral position and in which the several indicator means act in concert to provide a visual indication of the die supporting camber provided by the wedge members.

Having described this invention, the above and further objects, features and advantages thereof will appear to those skilled in the art from the following description of a preferred embodiment, illustrated in the accompanying drawings and representing the best mode presently contemplated for enabling those skilled in the art to practice its teachings.

IN THE DRAWINGS

FIG. 1 is a perspective view of a compensating die holder assembly embodying the present invention;

FIGS. 2 and 3 are end elevations of a die holder and wedge member, respectively, employed in the assembly of FIG. 1;

FIG. 4 is an end elevation of a bolster member operable with the die holder and wedge members of FIGS. 2 and 3;

FIG. 9 is an enlarged partial cross section showing the assembled relationship of the wedge and indicator means.

DESCRIPTION OF THE PREFERRED EMBODIMENT

Figure 5:
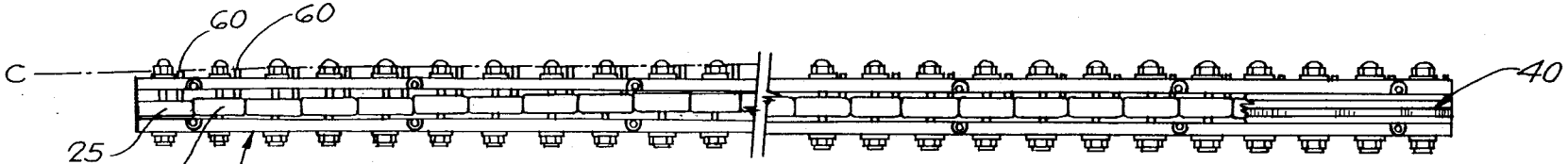
FIG. 5 is a foreshortened top plan view of the compensating die holder assembly shown in FIG. 1, with the die and die holder partly removed, to illustrate the assembled adjustable wedge means.

With reference now to FIGS. 1–4 of the drawings in particular, a bolster block 15 is shown for use with the bed of a press brake comprising an elongated rigid metal body of steel or light weight aluminum alloy, having a generally U-shaped cross-section provided with an elongated rectangular cross sectioned channel 16 opening inwardly of the top face of the block 15 and extending the full length of the latter. With respect to the bolster block, such may extend the full length of the press bed or be made in short sections to provide independent crown and adjustment heights and/or match height tooling requirements. The block 15 as shown is formed with two upwardly extending parallel arm portions 17 and 18 which laterally define channel 16. Arm 18 is of shorter extent than arm 17 to accomodate a lip or flange associated with a die support, as will appear presently. On the bottom face of the block 15 is a longitudinally extending groove 19 which accomodates an insert anchor rib 20 in the illustrated case or alternatively such rib 20 may be formed integrally with the block 15. Rib 20 is adapted to fit the usual upwardly open channel in the bed of the press brake to hold the bolster from displacement both longitudinally and transversely of the bed in operation.

Mounted within the channel 16 and engaging the bottom wall thereof are wedge means comprising a plurality of wedge members 25. Typically the wedge members approximate 6 inches in length and have a width dimension less than the width of the channel 16. For example, if the channel is in the order of 3 inches in width, the individual wedge members will be in the order of $2\frac{1}{2}$ inches wide. This difference in dimension permits movement of the wedge members transversely across the channel 16, as will be described in greater particular hereinafter. As shown, the wedge members 25 have an inclined upper wall 26 sloping transversely of the wedge body at a desired angle, for example about 10° to the horizontal.

In the illustrated case (see FIG. 2) the die support 30 constitutes an elongated metal body coextensive with the length of the bolster block 15 and having a width matching that of the upwardly open channel 16 of the bolster block so that the die support may slide vertically within the channel, closely guided by and between arm 17 and 18 of the bolster. As shown the lower face 31 of the die holder is sloped to match the upper face 26 of the wedge members, it will be appreciated that lateral movement of the wedge members 25 across the channel 16 beneath the sloping surface 31 of the die holder 30, will affect vertical movement of the latter within and between the parallel upright arms 17 and 18 of the bolster.

As further illustrated in FIGS. 1 and 2 in particular, the die holder 30 is provided with a flanged lip portion 32 along one longitudinal side thereof. This provides a surface for precise measurement of crown height by means of feeler gauge between the underface of lip 32 and upper end 33 of the bolsters shorter arm 18. Upper wall 34 of the die holder is suitably channeled as at 35 to accept a tongue 36 of an overlying forming die 40 in assembly, as best illustrated in FIG. 1 of the drawings. With insertion of the tongue 36 into the channel opening 35 of the die holder, the die 40 is held in fixed position on the die holder in the usual manner, as by a series of set screws (see FIG. 1) which travel in threaded openings 41 extending laterally through the upper sides of the die holder to invade the channel opening 35, and engage the die tongue 36 in a known manner.

Figure 7:
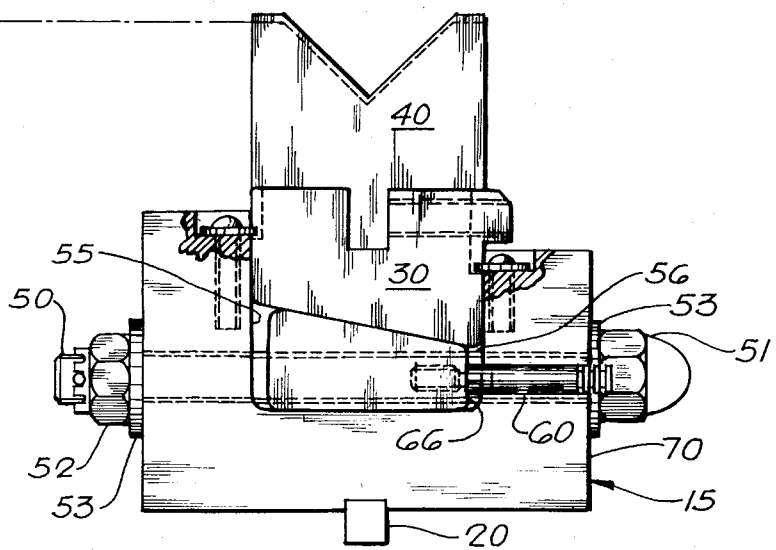
FIG. 7 is another end elevation thereof with portions in sections, similar to FIG. 6, but showing the wedge means and cooperating indicator means in adjusted positions.
Figure 6:
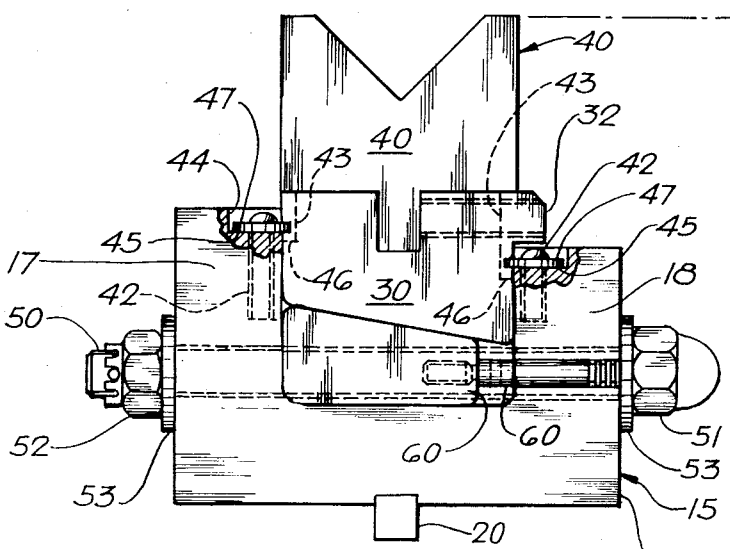
FIG. 6 is an end elevation of the assembly shown in FIGS. 1 and 5 with portions in section, showing the wedge means and indicator means in a neutral operating position.

Upward movement of the die holder 30 within the channel 16 of the bolster is limited by a series of hold down cap screws and washers 42, threadingly extending into the bolster and laterally invading the die holder at spaced locations along the length thereof; specifically, bored shoulder recesses 43 and 44 along opposite sides of the die holder and bolster provide stop shoulders 45 and 46, respectively, engageable by the washer members 47 beneath the heads of the hold down bolts 42 (see FIGS. 6 and 7).

From the foregoing it will be appreciated that the described structure provides an assembly of the bolster 15, wedge means 25, die holder 30 and forming die 40 in which the die holder 30 moves vertically within the confines of the bolster's channel opening 16 in response to movement of the wedge means. In order to insure smooth, accurate movement of the die holder within the bolster channel, the side walls of the die holder closely fit with the interior side walls of the channel opening 16 while the sloping underface 31 of the die holder and the upper face 26 of the wedge means are of identical angular disposition and interengage.

To actuate the wedge means 25 comprising one or more individual wedge members as heretofore described, a series of through bolt means 50 are provided to extend transversely through the bolster and wedge members; the same being threadingly engaged with threaded bores formed through the individual wedge members. One such through bolt is associated with each wedge member. As shown in FIGS. 6 and 7, the through bolts comprise elongated exteriorly threaded cylindrical rods having a cap nut 51 welded over one outer end thereof and fitted with a castle nut and pin means 52 secured over the opposite end thereof; the nut members 51 and 52 residing outwardly of the side walls of the bolster and disposed over intervening thrust washers 53. With this arrangement rotation of each through bolt means 50 serves to threadingly advance or retract its associated wedge means 25 across the bottom end of the channel opening 16 in the bolster. In the particular preferred embodiment illustrated, the threaded engagement of the through bolts with the wedge means is such that one full turn of a through bolt effectuates a 0.010″ rise or fall of the die holder and a 0.055″ travel of the wedge means; the slope of the wedge means being 10° to the horizontal. While such figures illustrate a typical arrangement, they are by no means limitive of the invention in that any desired selection of wedge slope and through bolt thread arrangement may be selected as desired.

In FIG. 6 of the drawings, the wedge means 25 is shown located in an extreme left hand or starting neutral position against the inside wall 55 of bolster arm 17 (see FIG. 4). By rotating the through bolt means 50 in a clockwise direction, as when addressing the hexagonal head nut 51, the wedge means 25 will travel to the right (see FIG. 7) until it reaches the opposite inside wall 56 of the channel opening 16. As noted above, in one typical preferred arrangement, one full rotation of the through bolt means 50 effects 0.055″ travel of the wedge means and depending on the direction of movement for the wedge means, either toward or away from the wall 55, the die holder will fall or rise 0.010″.

It is to be noted that the utilizaton of the through bolt arrangement described reinforces the bolster arms 17 and 18 against spreading and strengthens the same against the impact forces effected by the pressures applied against the die means 40 in operation. This permits less metal and a lighter construction to be employed than if the screw means were extended through only one side of the bolster.

As discussed heretofore, the purpose of the moveable wedge means beneath the die holder is to effect a desired camber to the undersupport of die 40 in order to accomodate variations in the press bed, work piece metal, etc. It is essential however, that the extent of the adjusting camber be known and heretofore such has been done either by laboriously placing a number of shims of known thickness at spaced intervals beneath the die or die holder and/or by advancing the wedge means from a start position to effectuate desired lateral wedge movement, as in the Bath U.S. Pat. No. 2,456,856 mentioned hereinabove. In either case, adjustment of the wedge means to effect a desired camber along the length of the die holder has heretofore been a laborious, time consuming an uneconomic practice which generally required repetition of the entire die adjusting process if a change in camber were desired. A press operator, for example, had to rely on a die setter or set-up man to effectuate the desired adjustment of the wedges accompanied by an attendant shut down of the press until the necessary camber adjustment had been completed. Once set, if adjustment of the wedges changed, the operator was basically at a loss to effctuate the necessary correction. As noted above, the present invention alleviates this problem by providing means capable of indicating and measuring the disposition of the individual wedge members as well as visually indicating to the operator the overall camber applied to the die support. To this end, particular reference is now made to FIGS. 5 through 9 of the drawings from which it will be recognized that the die holder assembly hereof is provided with a plurality of spaced indicator pins or means 60 extending laterally through one side of the bolster; specifically, in the illustrated case, through the upright leg portion 18 thereof. One indicator means is associated with each of the individual wedge members as shown specifically in FIG. 5 of the drawings.

Figure 8:
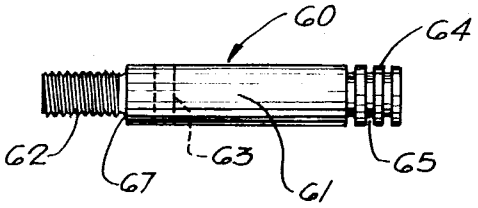
FIG. 8 is a side elevation of the indicator means.

For a better understanding of the specifics of the indicator means 60 references is now made to FIG. 8 of the drawings wherein is illustrated indicator means having a generally cylindrical body 61 formed with a threaded inner end portion 62 of reduced diameter and an adjacent transverse opening 63 extending therethrough for purposes which will appear presently. The opposite or outer end of the pin means is formed with scale means shown herein as comprising a plurality of alternate exterior lands 64 and grooves 65. By way of example, each land and groove may measure 0.055" axially of body 61. This measurement is in accordance with the wedge travel effectuated by one rotation of the through bolt means 50, as heretofore noted. In order to accurately reflect movement of the wedge means 25, each wedge member thereof is fitted with one of the indicator pins 60 in the manner best shown in FIGS. 6, 7 and 9 of the drawings. As there noted, each pin means 60 extends through a smooth walled bore opening formed through leg portion 18 of the polster, with the threaded inner end 62 of the pin means engaged with a threaded bore formed inwardly of one lateral side 66 of a wedge member. In order to tighten the pin members in their respective wedge members, the through openings or bores 63, noted above, permit the insertion of a tool, such as an allen wrench or like instrument, for rotating the pin member 60 until the shoulder 67 adjacent threaded end portion 62 thereof tightly abuts face 66 of the wedge member. This is best done with the die support 30 removed from the channel groove 16 and with the wedge members 25 located in tandem adjacency along channel 16 (see FIG. 5) against the rear wall 55 of the channel opening 16. When so mounted, it will be noted the wedge members are in their FIG. 6 positions, abutting the rear wall of the channel opening 16, with the outer end of the pin body 61 flush with the side face 70 on bolster means 15. Thus, the indicator pin means do not project beyond face 70 when the wedge members are in their zero or neutral start positon, as shown in FIG. 6. With rotation of the through bolt means 50, the wedge members advance toward the opposite wall 56 of the channel groove 16. As illustrated in FIG. 7, rotation of the bolt means 50 has advanced pin means 60 to the right a distance equal to the second land 64 and second groove 65. Inasmush as each land and each groove occupies an axial distance of 0.055" (equal to a height change of 0.010" overall), the indicator means 60, according to FIG. 7 of the drawings, shown that the wedge means 25 has advanced 0.220" with an overall height change increase of 0.040". Thus, the lands and grooves so provided on the indicator pins provide a measurement scale to visually indicate to the operator the distance each wedge means has traveled from its zero or neutral position and an exact measurement of the overall height difference effected by each wedge member.

In addition to the above described indicating and measuring function, the adjustment of the various wedge members produces a corresponding response of the indicator means 60, which, taken in concert, provide a visual indication of the adjusted camber presented to the die holder, as shown by dotted line C on the left hand portion of FIG. 5 of the drawings. Thus, by sighting along the outer ends of the indicator means 60, the operator can get an immediate visual indication of the extent and shape of the camber adjustment effected by the wedge means.

In addition to the foregoing and by way of accomplishing the desireable objective of permitting adjustable movement of the wedge means without having to zeroize their position each time, the operator by virtue of the measuring scale system at the outer end of the indicator pins is capable of rotating the adjustment bolt members 50 to effect desired advancement or retraction of individual wedge members to correct deficiencies experienced in the press bending operation.

From the foregoing it is believed that those familiar with the art will readily recognize the novel advancement presented by this invention over prior compensating die holders and will readily appreciate that while the same has been described in conjunction with a particular preferred embodiment thereof illustrated in the accompanying drawings the same is susceptible to variation, modification and subtitution of equivalents without departing from the spirit and scope of the invention which is intended to be unlimited by the foregoing except as may appear in the following appended claims.

I claim:

1. A compensating die holder for use with a press brake, comprising: a bolster block having means for attachment to the bed of the press and comprising an elongated rigid body of substantially U-shaped cross-section formed with an elongated channel opening inwardly of one face thereof; said channel being laterally confined between parallel arm portions of said body; an elongated die holder mounted in said channel for limited vertical movement guided by opposing walls of said arm portions; wedge means mounted between the bottom of said channel and said die holder for limited movement transversely of said channel; such movement of said wedge means effecting vertical movement of said holder; bolt means extending transversely through said body and wedge means and having threading engagement only with the latter whereby to adjustably move said wedge means transversely of said channel in response to rotation of said bolts means; and indicator means, independent from said bolt means, which are responsive to movement of said wedge means and operable to visually indicate, externally of said body the transverse position of said wedge means in said channel.

2. The invention of claim 1 wherein said wedge means comprises a plurality of individual wedge members mounted in tandem adjacency in said channel to provide under support for said die holder; each said wedge member having an indicator means associated therewith.

3. The invention of claim 2 wherein said bolt means comprises a plurality of bolt members, one threadingly associated with each of said wedge members, to effect individual positioning of said wedge members in said channel.

4. The invention of claim 3 wherein said indicator means, cooperate to visually indicate the relative positions of said individual wedge members in said channel.

5. The invention of claim 1 wherein said indicator means comprises elongated pin means separate from said bolt means and attached to and moveable with said wedge means; said pin means extending through at least one of said arm portions so as to visibly protrude from the exterior of said bolster.

6. The invention of claim 2 wherein each said indicator means is formed with scale means visually readable exteriorly of said bolster and operable to measure the displacement of each said wedge means from a zero or neutral position in said channel and the consequential height adjustment of said die holder.

7. A compensating die holder for use with press brakes, comprising: elongated bolster means attachable to the press bed and formed with an elongated open channel recessed in the upper side thereof, die holder means mounted in said channel for vertical movement, wedge means mounted in said channel beneath said holder means for movement between limits transversely of said channel to effect vertical movement of said holder means, adjustment means coupled to said wedge means and operable for adjustably moving said wedge means transversely of said channel, and indicator means independent from said adjustment means and extending from said wedge means to the outside of said bolster means; said indicator means being attached to and moveable responsively with said wedge means and presenting a portion thereof which is visible outside of said bolster means for visually indicating the position of said wedge means in said channel.

8. The die holder of claim 7, wherein said indicator means comprises elongated pin means fastened at one end to said wedge means and extending therefrom to the outside of said bolster means; the other end of said pin means lying flush with the outside face of said bolster means when said wedge means is at one limit of its movement and said portion of said pin means projecting outwardly of said face when said wedge means is displaced from said one limit.

9. The die holder of claim 7, wherein there are plural wedge means in said channel, each independently moveable by associated adjustment means, and indicator means associated with each wedge means; the several indicator means cooperating to visibly shown the relative positions of the several wedge means in said channel.

10. The die holder of claim 8, and linear scale means provided on said portion of said pin means; said scale means being readable outside said bolster means when said wedge means is displaced from said one limit thereby to operatively measure displacement of said wedge means.

11. In a compensating die holder for use with a press brake having elongated bolster means attachable to the press bed for supporting die holder means moveable in an elongated channel of the bolster means, and wedge means moveable in the channel for adjustably actuating the die holder, the improvement comprising: indicator means extending between the wedge means and an outside face of the bolster means for indicating the position of the wedge means in said channel; said indicator means being freely slideably moveable within the bolster means and responsive to the movement of said wedge means and having a visible portion coplanar with or projecting from said outside face for indicating the position of the wedge means in said channel.

* * * * *